US005599192A

United States Patent [19]

Olson

[11] Patent Number: 5,599,192

[45] Date of Patent: Feb. 4, 1997

[54] BLADE-LIKE TERMINAL HAVING A PASSIVE LATCH

[75] Inventor: Stanley W. Olson, East Berlin, Pa.

[73] Assignee: Berg Technology, Inc., Reno, Nev.

[21] Appl. No.: 197,499

[22] Filed: Feb. 16, 1994

Related U.S. Application Data

[63] Continuation of Ser. No. 20,489, Feb. 22, 1993, Pat. No. 5,310,357.

[51] Int. Cl.[6] ..... H01R 9/09

[52] U.S. Cl. ..... 439/65; 439/660

[58] Field of Search ..... 439/284–293, 439/62, 65, 660, 842–856, 861, 79, 78

[56] References Cited

U.S. PATENT DOCUMENTS 2,997,685 8/1961 Anderson ..... 439/849

3,065,451 11/1962 Rutter ..... 439/849

*Primary Examiner*—David L. Pirlot

*Attorney, Agent, or Firm*—Woodcock Washburn Kurtz Mackiewicz & Norris

[57] ABSTRACT

This invention relates to connector assemblies for electrically and mechanically connecting one printed circuit board to another and, in particular to connector assemblies having blade-like terminals engaging cantilever beam terminals for electrically and mechanically connecting one printed circuit board to another. The present invention uses a passive latch to increase the withdrawal force without significantly increasing the insertion force of the terminals in connectors in the connector assemblies.

19 Claims, 11 Drawing Sheets

BLADE-LIKE TERMINAL HAVING A PASSIVE LATCH

This is a continuation, of application Ser. No. 08/020,489, filed Feb. 22, 1993 now U.S. Pat. No. 5,310,357.

BACKGROUND OF THE INVENTION

1. Field of the Invention

This invention relates to connector assemblies for electrically and mechanically connecting one printed circuit board to another and, in particular, to connector assemblies having blade-like terminals for engaging cantilever beam terminals for electrically and mechanically connecting one printed circuit board to another.

2. Description of Related Art

The telecommunication and personal computer industries are progressing towards smaller portable products. At the same time, they demand the cost savings offered by surface mount technology.

Initially, the connector industry developed surface mount connectors around the 2.54 mm (0.1 inch) standard spacing or footprint typical of many still existing pin and socket and edge card products. A surface mount connector having a 2.54 mm footprint has terminals adapted to be soldered to conductive pads spaced 2.54 mm from the center line of one pad to the center line of an adjacent pad on a circuit assembly. Then 1.27 mm (0.05 inch) center line products emerged and the trend toward miniaturization was established. In response to the lastest needs of the telecommunication and personal computer industries, a 1.0 mm (0.039 inch) connector offering is emerging.

One such connector product line having a 1.0 mm (0.039 inch) footprint is referred to as the Conan Product line which includes low profile surface mount receptacles and headers for interconnecting parallel printed circuit boards as illustrated in FIG. 1. Such Conan connectors are commercially available from Berg Connector Systems, Inc., with offices in Valley Green, Pa.

More specifically, FIG. 1 shows a Conan header 10 in a mating position with respect to a Conan receptacle 12. The header 10 comprises an insulative housing 14 having a plurality of passages and a plurality of blade-like terminals 18, one of the terminals 18 extending through each of the passages. Tails 20 of the blade-like terminals 18 are illustrated solderable to pads 22 on a first printed circuit board 24. The receptacle 12 comprises an insulative housing 26 having a plurality of passages and a plurality of cantilever beam terminals 30, one of the cantilever beam terminals 30 extending through each of the receptacle passages. Tails 32 of the cantilever beam terminals 30 are illustrated solderable to pads 34 on a second printed circuit board 36 which is parallel to the first printed circuit board 24. Contact portions of the blade-like terminals 18 engage contact portions of the cantilever beam terminals 30 and, thus, function to electrically interconnect the first and second printed boards 24,36.

In most cases, the typical mode of mating two boards is by hand, even though the board assembly and soldering operations are highly automated. The connectors often also function as the mechanical feature that locks the two boards together and maintains the spacing between the two boards. When used to lock two boards together, the pressure and friction force of the contact portions of the blade-like terminals against the contact portions of the cantilever beam terminals is what mechanically holds the first printed circuit board to the second printed circuit board in the mating position illustrated in FIG. 1. However, this friction or withdrawal force is often insufficient to hold the boards together. Further, many blade-like terminals, including the ones illustrated in FIG. 1, have insertion ramps or inclined insertion ends 38 which are designed to faciliate insertion of the header 10 into the receptacle 12, but which also cause the receptacle 12 to be pushed away or ejected from the header 10 once the contact portions of the cantilever beam terminals 30 have been pulled across a flat region of the blade-like terminals 18 and reach the insertion ramps 38 of the blade-like terminals 18. It has also been noticed that when the contact portions of the cantilever beam terminals 30 are withdrawn from the mated position (illustrated in FIG. 1) onto the ramps or inclined ends 38 of the blade-like terminals 18, the force tending to eject the header 10 from the receptacle 12 is greater when the header 10 is being rotated, such as, in the direction of arrow A in FIG. 2, than when the header 10 is withdrawn along a straight line, such as, in the direction of arrow B in FIG. 3. Although less force is required to uncouple the connectors illustrated in FIG. 2, a small accidental movement of the boards 24,36 may cause uncoupling of the connectors 10,12 and the boards 24,36 in either the situation illustrated in FIG. 2 or the situation illustated in FIG. 3.

Active latching of the two connectors together isn't a practical solution to this problem because there isn't room to disengage latches. Other board mounted components in close proximity frequently pose problems to using active latches.

Thus, there is a need to increase the unmating force without significantly increasing the insertion force of conventional blade-like terminals with respect to cantilever beam terminals in connector assemblies to increase resistance to accidental unmating.

SUMMARY OF THE INVENTION

The invention relates to a blade-like terminal for mating with a cantilever beam terminal and for mechanical and electrical connection to a circuit assembly, comprising:

- an insertion end portion having wings for placement in a linear slot in a connector housing;
- a strip-like contact portion having a substantially flat surface for wiping and contacting the cantilever beam terminal;
- a first transistion portion connecting the insertion end portion and the strip-like contact portion, the first transistion portion comprising a retentive bump;
- a solderable tail portion for mechanical and electrical connection to the circuit assembly; and
- a second transistion portion connecting the strip-like contact portion and the solderable tail portion, the second transistion portion comprising retentive means for securing the blade terminal in the connector housing.

The invention is further directed to a first connector for interconnecting a second connector with a plurality of cantilever beam terminals and a circuit assembly, comprising:

- an insulative connector housing having a base and a first wall generally perpendicular to the base, the first wall with a plurality of parallel slots;
- a plurality of blade terminals, each one of the blade terminals comprising:
  - an insertion end portion having wings for placement in one of the parallel slots;

a strip-like contact portion having a substantially flat surface for wiping and contacting one of the cantilever beam terminals;

a first transistion portion connecting the insertion end portion and the strip-like contact portion, the first transistion portion comprising passive means for increasing the unmating force, more than the insertion force, of the first connector with respect to the second connector;

a solderable tail portion for mechanical and electrical connection to the circuit assembly; and a second transistion portion connecting the strip-like contact portion and the solderable tail portion, the second transistion portion comprising retentive means for securing the blade terminal in the connector base.

The invention is further directed to a connector assembly for interconnecting a first circuit assembly and a second circuit assembly, comprising:

a first connector for mechanical and electrical connection to the first circuit assembly;

a second connector for mating with the first connector and for mechanical and electrical connection to the second circuit assembly, the second connector comprising:

an insulative connector housing having a base and a first wall generally perpendicular to the base, the first wall with a plurality of parallel slots;

a plurality of cantilever beam terminals, each one of the cantilever beam terminals comprising:

a first beam having a first substantially straight portion and a second substantially straight portion, the first substantially straight portion joined to the second substantially straight portion by a bent first contact portion;

a second beam having alignment wings for centering the second beam within one of the parallel slots and retentive means for securing the cantilever beam terminal in the connector housing;

a bent transistion portion joining the second substantially straight portion of the first beam with the second beam such that the contact bent portion points away from the second beam; and a solderable tail portion connected to the second beam, the solderable tail portion for mechanical and electrical connection to the second circuit assembly;

the first connector comprising:

an insulative connector housing having a base and a first wall generally perpendicular to the base, the first wall with a plurality of parallel dove tailed shaped slots;

a plurality of blade terminals, each one of the blade terminals comprising:

an insertion end portion having restraining wings for confined movement within one of the parallel dove tailed shaped slots;

a strip-like first contact portion having a substantially flat surface for wiping and contacting one of the bent first contact portions of one of the cantilever beam terminals of the second connector;

a first transistion portion connecting the insertion end portion and the first contact portion, the first transistion portion comprising passive means for increasing the unmating force, more than the insertion force, of the first connector with respect to a second connector;

a solderable tail portion for mechanical and electrical connection to the circuit assembly; and a second transistion portion connecting the first contact portion and the solderable tail portion, the second transistion portion comprising retentive means for securing the blade terminal in the connector base.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
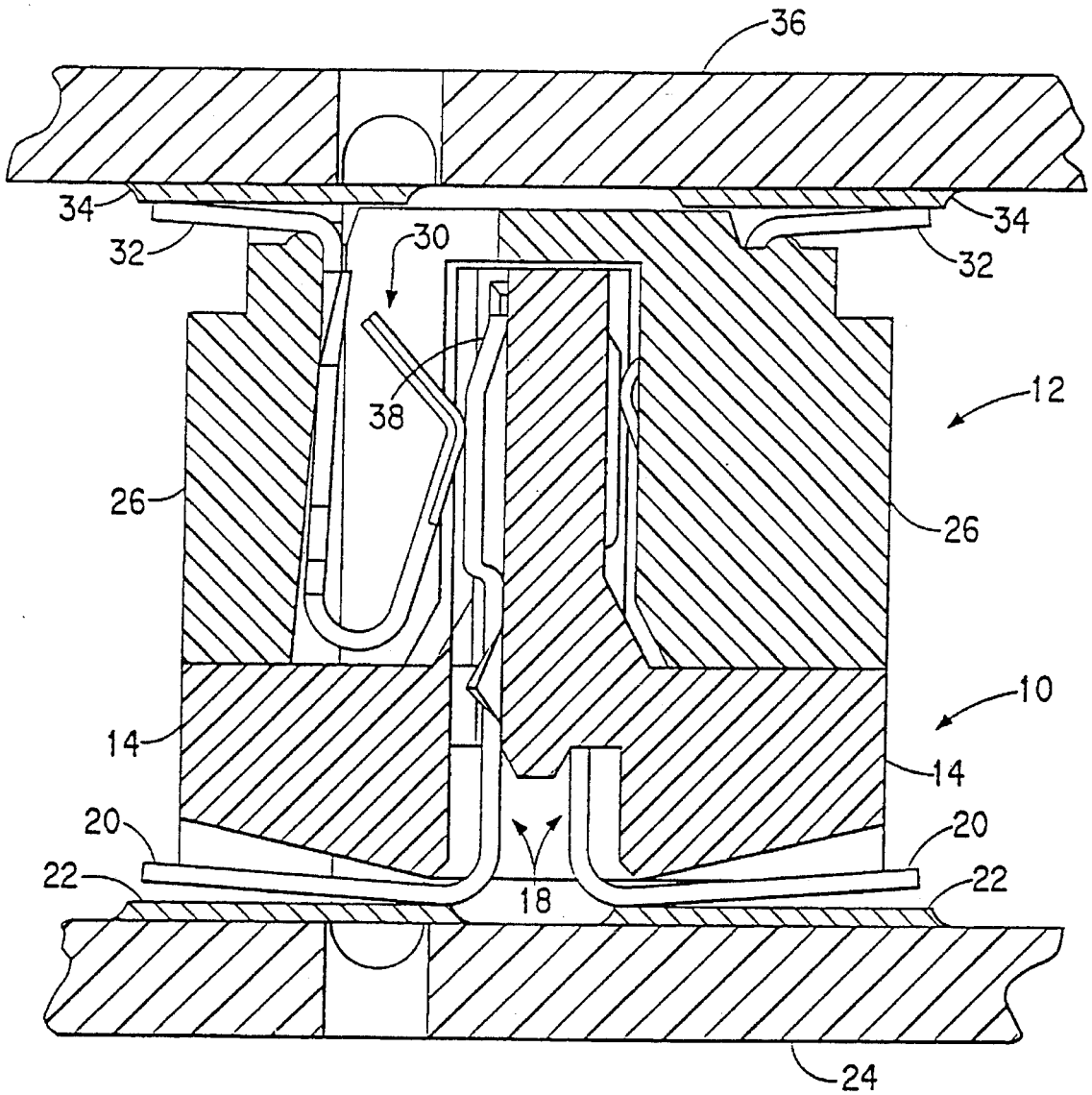
FIG. 1 (PRIOR ART)
FIG. 1 is a cross sectional view of a prior art low profile connector assembly showing a first connector in a mated position with respect to a second connector and electrically interconnecting a first circuit assembly and a second circuit assembly.
Figure 2:
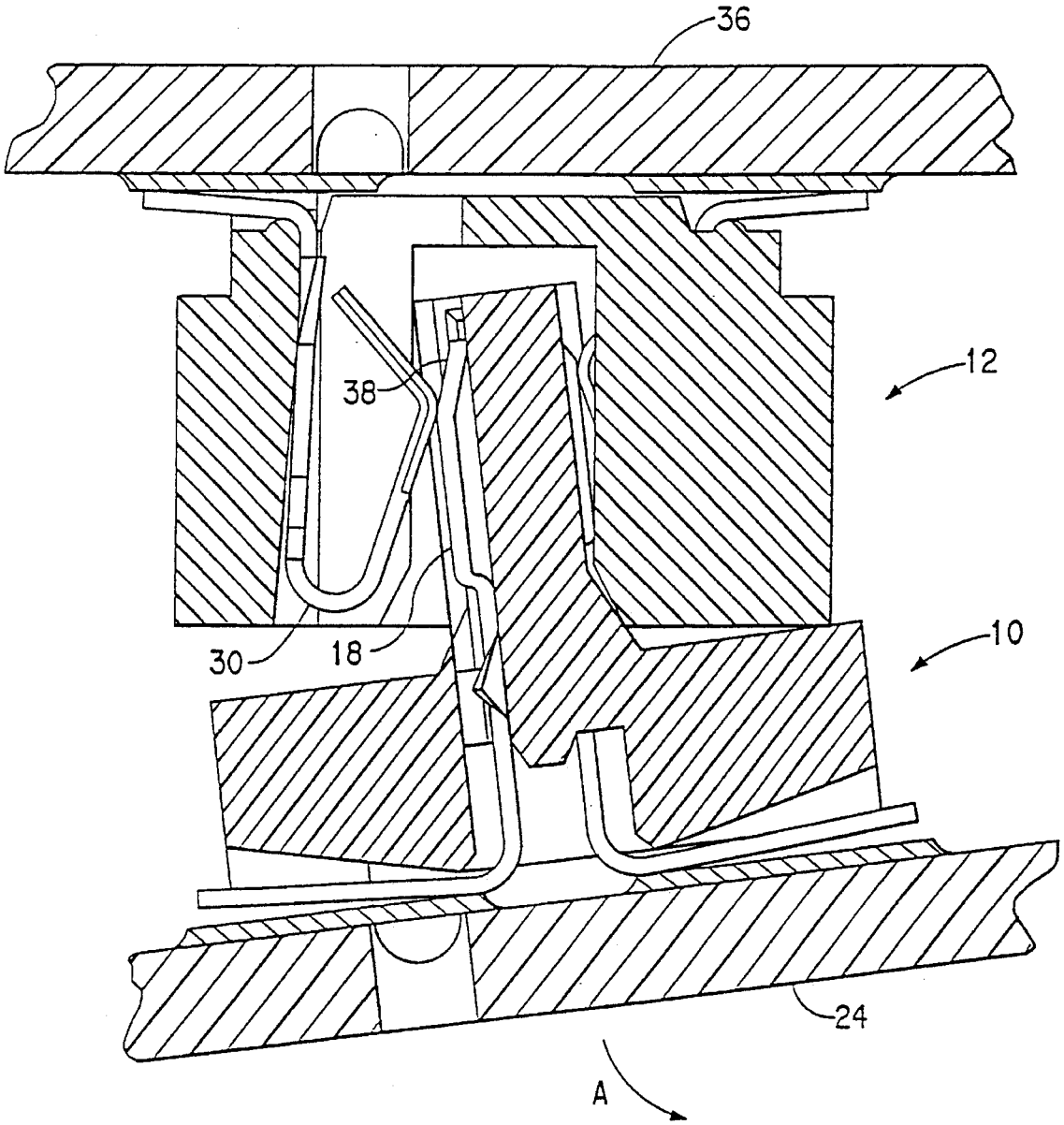
FIG. 2 (PRIOR ART)
FIG. 2 is a cross sectional view of the connector assembly of FIG. 1 with the first connector rotated and thus partly withdrawn from the mated position.
Figure 3:
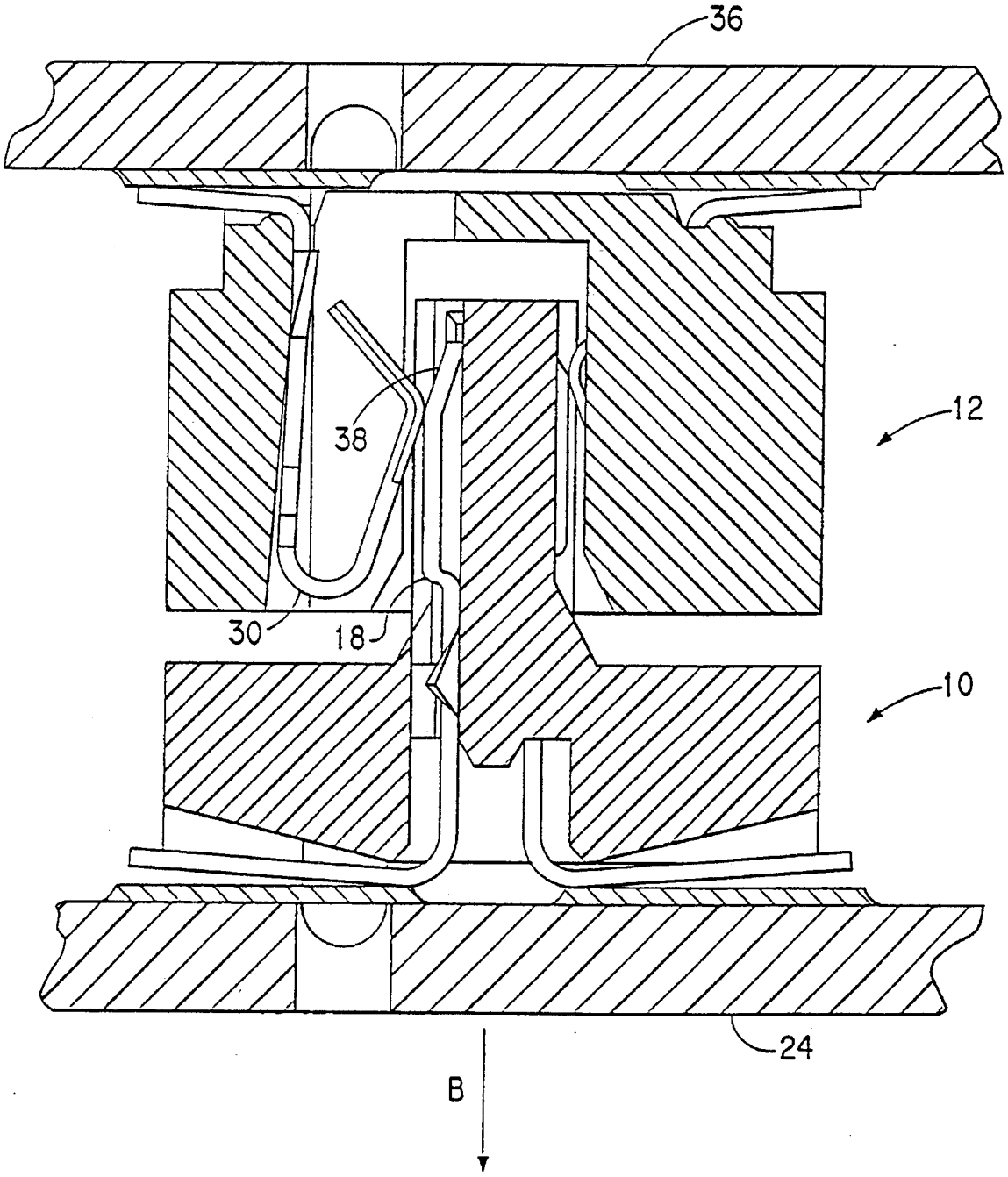
FIG.3 (PRIOR ART)
FIG. 3 is a cross sectional view of the connector assembly of FIG. 1 with the first connector withdrawn in a linear direction from the mated position.

Throughout the following detailed description, similar reference characters refer to similar elements in all figures of the drawings.

Figure 4:
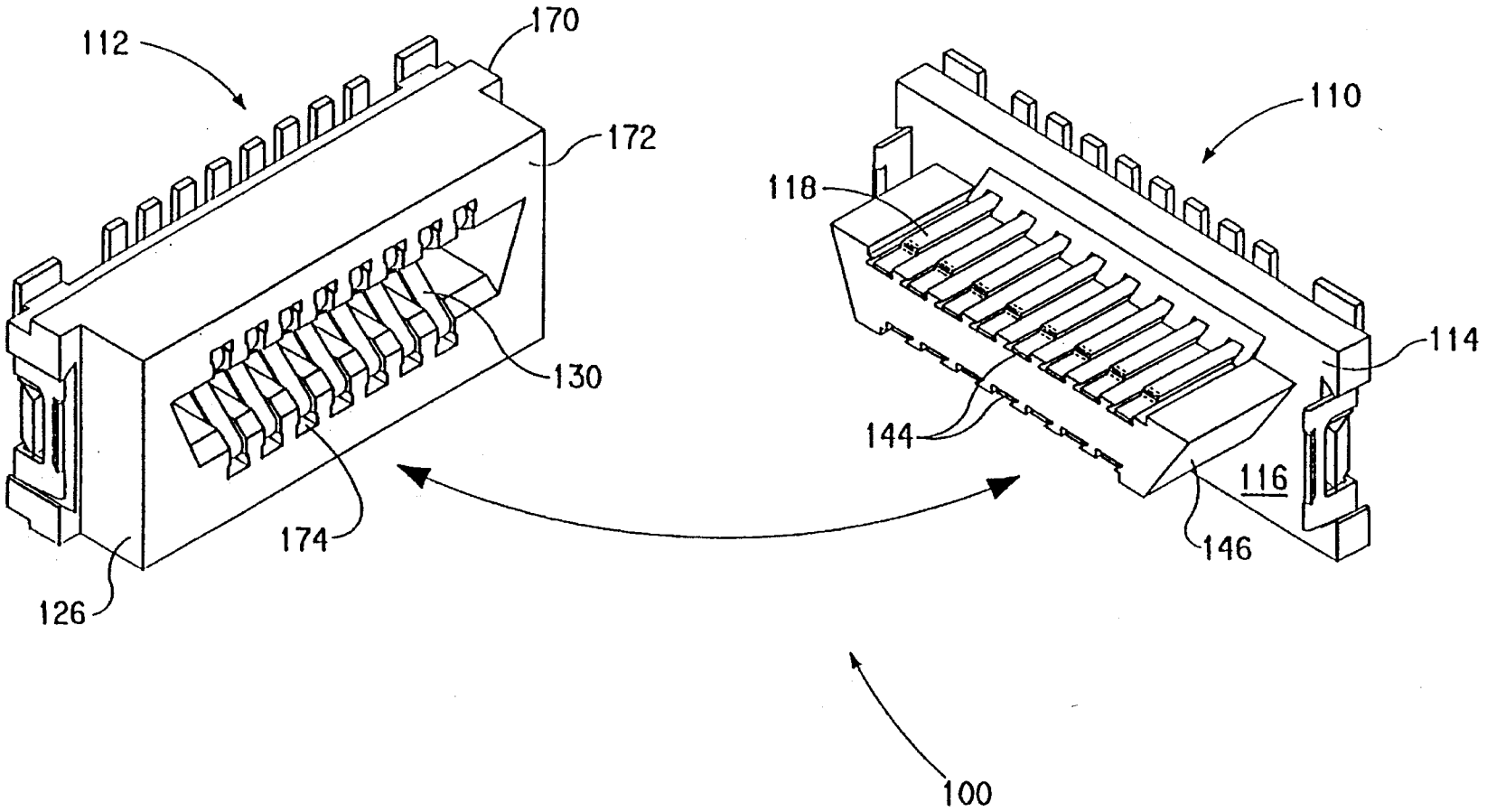
FIG. 4 is a view of a connector assembly comprising a first connector having blade-like terminals spaced from a mating second connector having cantilever beam terminals in accordance with the present invention.

Referring to FIG. 4, there is illustrated a connector assembly 100 comprising a first connector or header 110 spaced or exploded from a mating second connector or receptacle 112 in accordance with the present invention.

The header 110 comprises an insulative housing 114 having a plurality of passages through a base 116 of the housing 114 and a plurality of blade-like terminals 118, one of the terminals 118 extending through each of the passages. There can be two or more rows of the blade-like terminals 118. The terminals 118 in one row can be staggered with respect terminals 118 in the other row or adjacent rows. The housing 114 further comprises at least one wall 146 generally perpendicular to the base 116. The wall 146 has a plurality of linear parallel mortises, grooves or slots 144. One of the terminals 118 is partially received in each of the slots 144. Preferably, the slots 144 are dove-tailed shaped. The slots 144 are on at least one face and preferably two opposite faces of the wall 146.

The receptacle 112 comprises an insulative housing 126 having a plurality of passages through a base 170 of the housing 126 and a plurality of cantilever beam terminals 130, one of the cantilever beam terminals 130 extending through each of the receptacle passages. There can be two or more rows of the cantilever beam terminals 130 such that the terminals 130 mate with the terminals 118. The terminals 130 in one row can be staggered with respect terminals 130 in the other row or adjacent rows. The housing 126 further comprises at least one wall 172, and preferably two walls 172 generally perpendicular to the base 170. At least one (and preferably both) of the walls 172 has a plurality of linear parallel mortises, grooves or slots 174. One of the terminals 130 is partially received in each of the slots 174. Preferably, the slots 174 are dove-tailed shaped.

Figure 5:
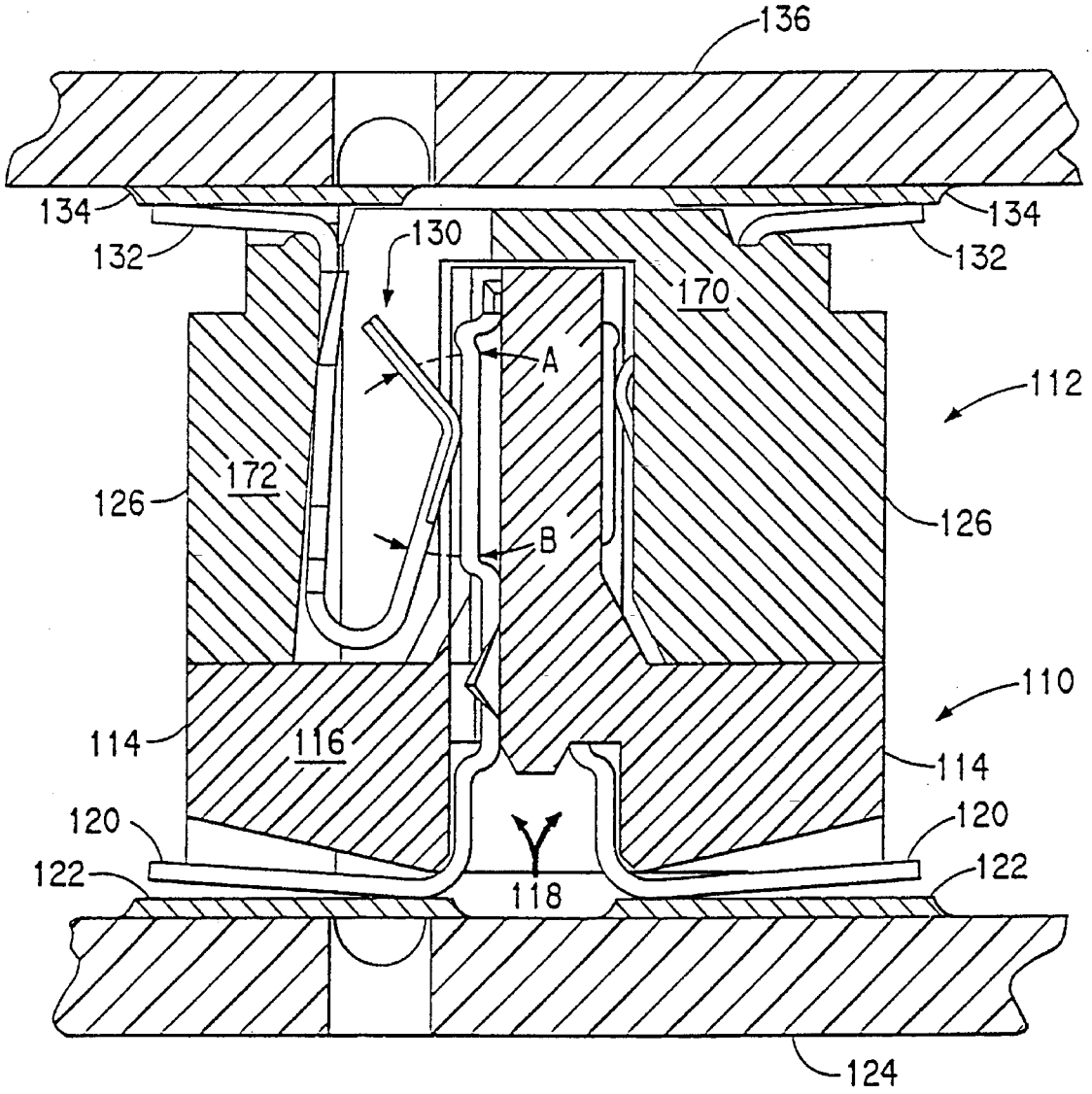
FIG. 5 is a cross sectional view of the connector assembly of FIG. 4 showing the first connector in a mating position with respect to the second connector and electrically interconnecting a first circuit assembly and a second circuit assembly in accordance with the present invention.

FIG. 5 shows a cross sectional view of the first connector or header 110 in a mating or mated position with respect to the second connector or receptacle 112. Tails 120 of the blade-like terminals 118 are illustrated solderable to pads 122 on a first printed circuit board or circuit assembly 124. Tails 132 of the cantilever beam terminals 130 are illustrated solderable to pads 134 on a second printed circuit board or circuit assembly 136 which is parallel to the first printed circuit board 124.

When the first connector 110 is mated with the second connector 112 as illustrated in FIG. 5, an angle A between the first substantially straight portion 178 of the first beam 176 of one of the cantilever beam terminals 130 and the strip-like contact portion 148 of a mating one of the blade terminals 118 is greater than an angle B between the second substantially straight portion 180 of the first beam 176 of the one cantilever beam terminal 130 and the strip-like contact portion 148 of the mating blade terminal 130. This causes the withdrawal force of header 110 from the receptacle 112 to be greater than the inserion force of the header 110 into the receptacle 112. Making angle A greater than angle B as shown in FIG. 5 increases the unmating force without significantly increasing the insertion force.

Figure 6:
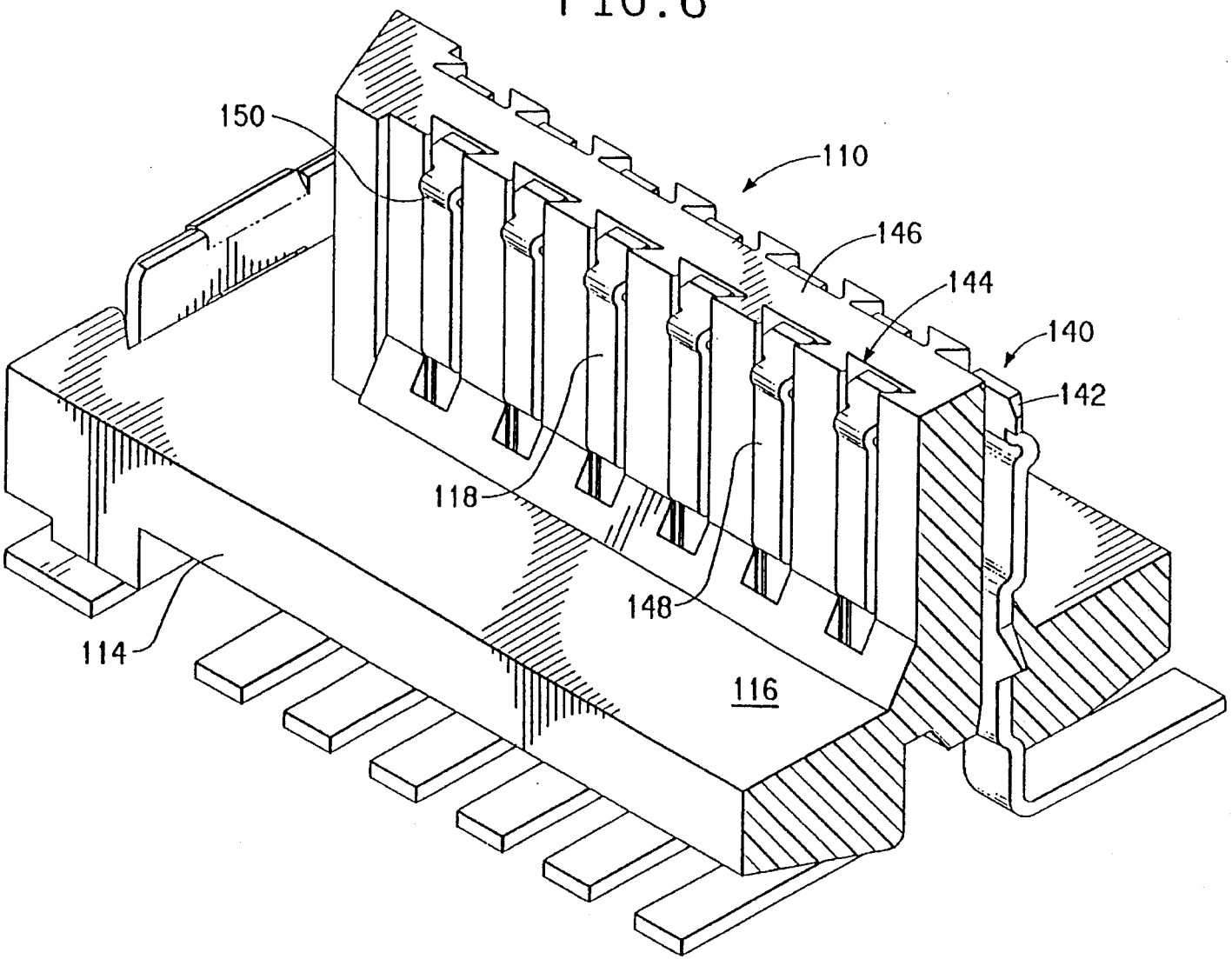
FIG. 6 is a perspective view of the first connector with a portion broken away to show details of the blade-like terminals in accordance with the present invention.
Figure 7:
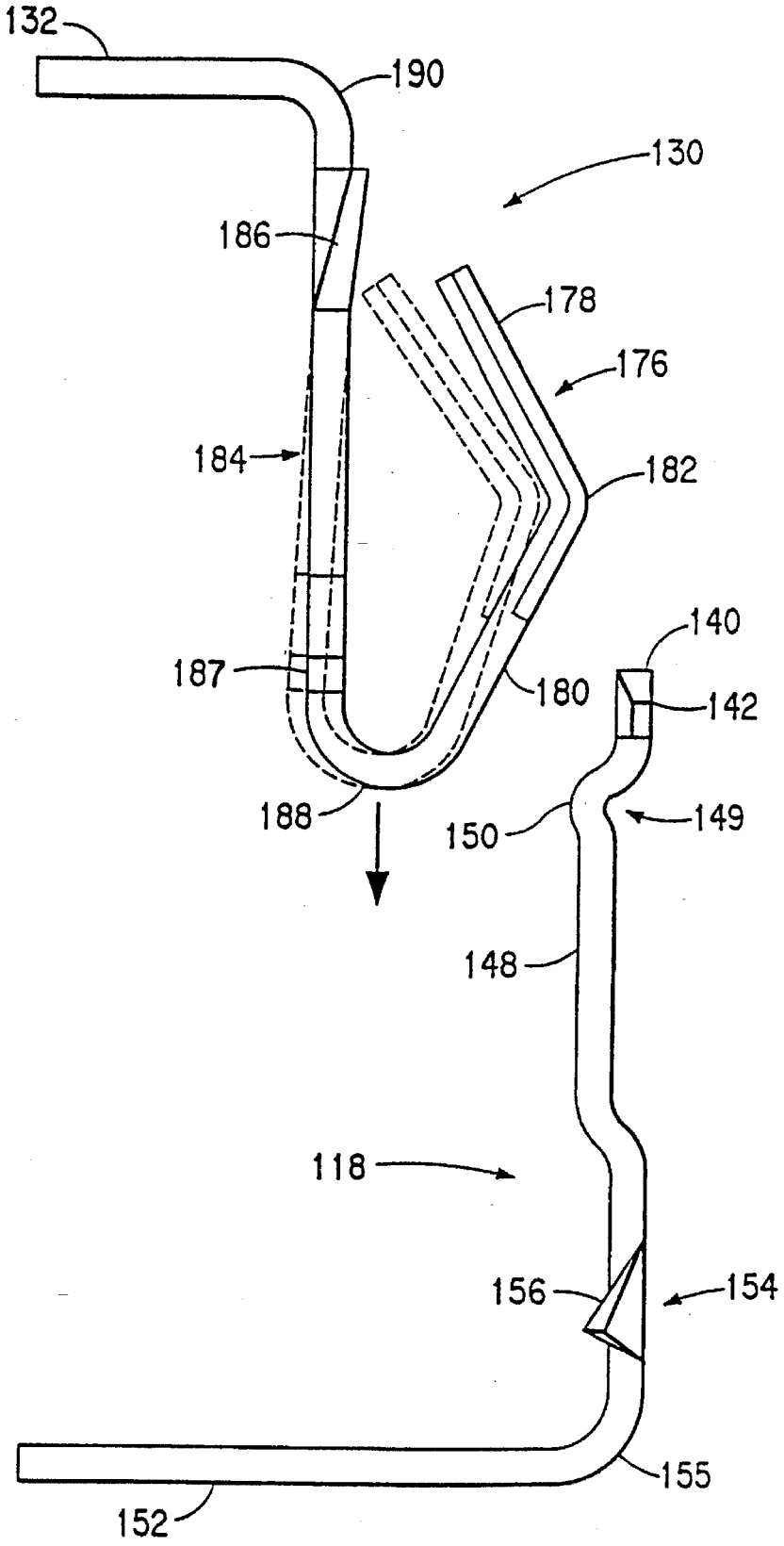
FIG. 7 is an enlarged view of one of the cantilever beam terminals in position to mate with one of the blade-like terminals in accordance with the present invention.

Referring to FIGS. 6 and 7, the blade-like terminals 118 each comprise an insertion end portion 140 preferably having alignment and restraining wings 142 for centered placement in, and confined movement generally along, one of the plurality of linear parallel slots 144 in the wall 146 of the header housing 114. Alternatively, the insertion end portion 140 can be fixed in a slot in the wall 146, the slot having a generally square or rectangular cross section. For instance, the insertion end portion 140 can have a barb that presses into a surface within the slot or wall 146. Each blade-like terminal 118 further includes a strip-like contact portion 148 having a substantially flat surface for wiping and contacting one of the cantilever beam terminals 130. A first transistion portion 149 connects the insertion end portion 140 and the strip-like contact portion 148. Preferably, the first transistion portion 149 includes a retentive bump 150. This retentive bump 150 is a passive latch which increases the withdrawal force of the receptacle 112 from its mated position with the header 110 without significantly increasing the insertion force required to insert the header 110 into the receptacle 112. Each blade-like terminal 118 further comprises a solderable tail portion 152 for mechanical and electrical connection to the first circuit assembly 124. A second transistion portion 154 connects the strip-like contact portion 148 and the solderable tail portion 152. The second transistion portion 154 includes retentive means 156 for securing the blade-like terminal 118, such as in the base 116, of the header housing 114. The second transistion portion 154 further comprises a knee or elbow portion 155 causing the strip-like contact portion 148 to be substantially perpendicular to the solderable tail portion 152.

Referring to FIG. 7, each one of the cantilever beam terminals 130 comprises a first cantilever beam 176 having a first substantially straight portion 178 and a second substantially straight portion 180. The first substantially straight portion 178 is joined to the second substantially straight portion 180 by a bent first contact portion 182. Each one of the cantilever beam terminals 130 further comprises a second base beam 184 having alignment wings 186 for centering and restraining the second beam 184 within one of the linear parallel slots 174. The second base beam 184 further comprises retentive means 187 for securing the cantilever beam terminal 130 in the base 170 of the connector housing 126. A bent transistion portion 188 joins the second substantially straight portion 180 of the first cantilever beam 176 with the second base beam 184 such that the contact bent portion 182 points away from the second beam 184. The tail 132 of the terminal 130 comprises a solderable tail portion 132 which is connected to the second beam 184 through a transistion portion 190 which causes the solderable tail portion 132 to be substantially perpendicular to the second cantilever beam 184. The solderable tail portion 132 is for mechanical and electrical connection to the second circuit assembly 136. For a more detailed description of the receptacle 112 and its cantilever beam terminals 130, see U.S. Pat. application Ser. No. 07/730,985 filed Jul. 16, 1991.

Figure 8A:
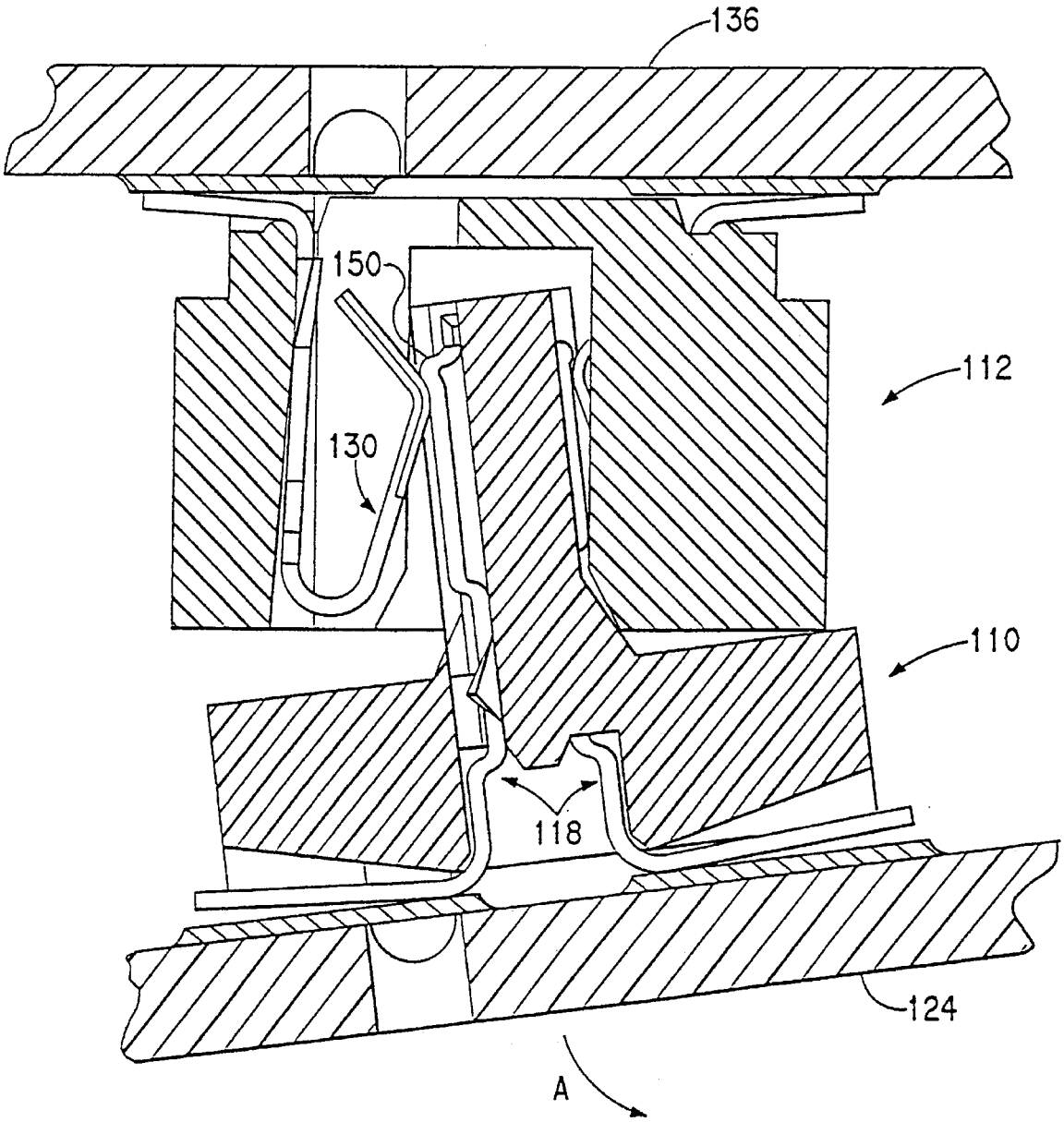
FIG. 8*a* is a cross sectional view of the connector assembly of FIG. 4 with the first connector rotated and partly withdrawn from the mated position.

FIG. 8*a* illustrates the connector assembly of FIGS. 4 and 5 with the first connector 110 rotated in the direction of arrow A with respect to its mated position with the second connector 112. Thus, the first connector 110 is partly withdrawn from its mated position with the second connector 112. It is clear from FIG. 8*a* that the operation of the passive latch 150 is to increase the unmating force of the first connector 110 with blade-like terminals 118 with respect to the second connector 112 with cantilever beam terminals 130 which increases resistance to accidental unmating.

Figure 8B:
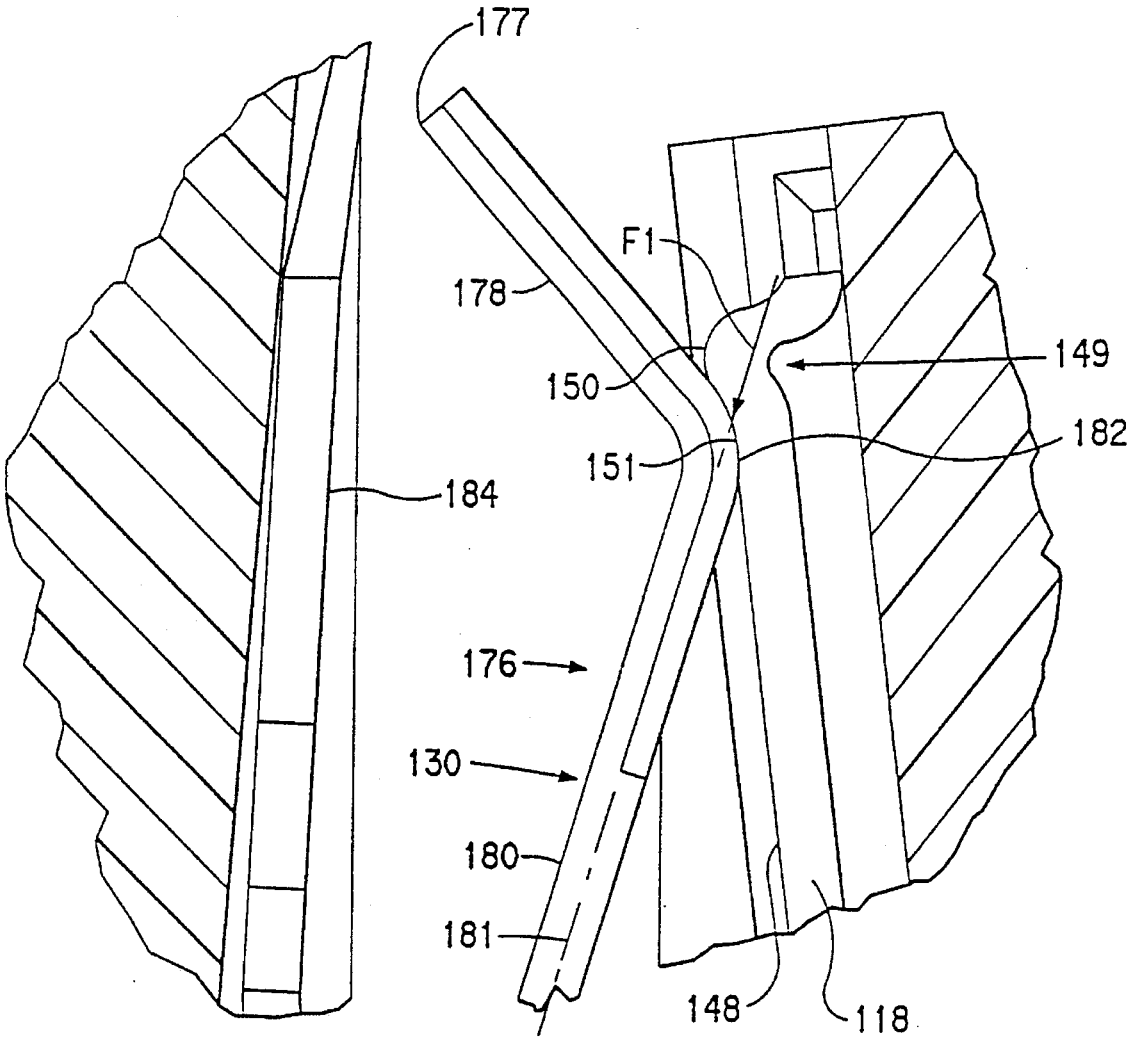
FIG. 8*b* is an enlarged view of part of FIG. 8*a*.

FIG. 8*b* is an enlarged view of part of FIG. 8*a* showing the bent portion 182 in contact with a curved surface 151 joining the retentive bump 150 and the strip-like contact portion 148. The curved surface 151 is part of the first transistion portion 149 and conforms to the shape of the bent portion 182 contacting the curved surface 151. Arrow F1 represents the effective force applied by the first transistion portion 149 on the bent contact portion 182 of the terminal 130 in FIG. 8*b*. The effective force, F, is defined as the sum of all the forces applied by the first transistion portion 149 on the bent contact portion 182 of the terminal 130. At the point of rotation of the first connector 110 with respect to the other connector 112 illustrated in FIG. 8*b*, the direction of the effective force $F_1$ is substantially towards, and substantially parallel to the longitudinal axis 181 of, the second substantially straight portion 180 of the terminal 130. This effectively places the second substantially straight portion 180 in compression along its longitudinal axis 181. Under these circumstances, the second portion 180 functions as a simple column under compression, rather than as a cantilever beam. This effectively locks the connectors 110 and 112 together virtually preventing separation. When the first connector 110 is rotated more in the same direction (as arrow A in FIG. 8*a*) with respect to its mated position with the second connector 112, an end 177 of the first substantially straight portion 178 will be forced into contact with the second base beam 184 of the terminal 130. When this occurs, the first beam 176 no longer functions as a column or a cantilever beam, but then functions as a simple beam supported at both ends.

Figure 9A:
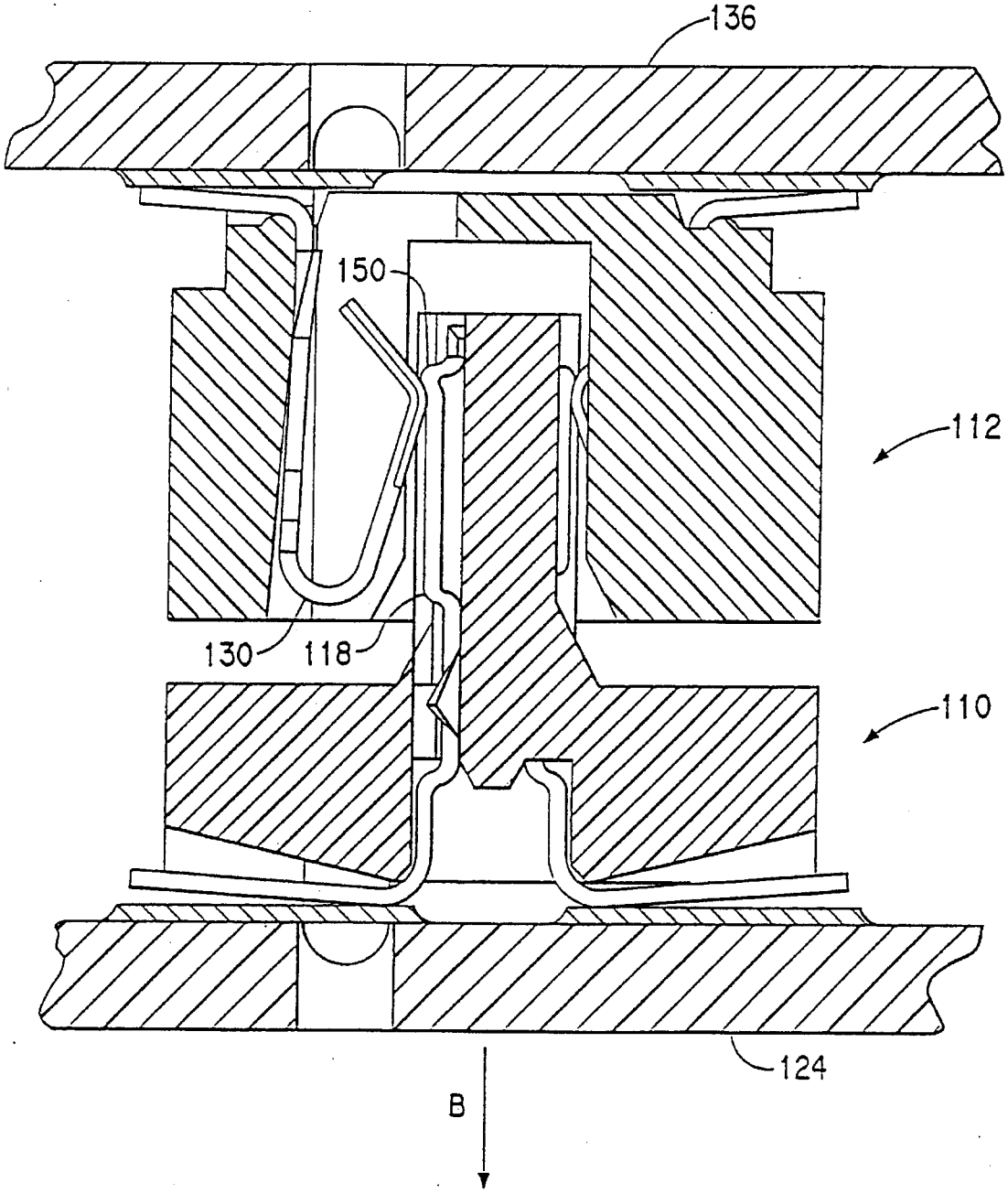
FIG. 9*a* is a cross sectional view of the connector assembly of FIG. 4 with the first connector partly linearly withdrawn from the mated position.

FIG. 9*a* illustrates the connector assembly of FIGS. 4 and 5 with the first connector 110 slightly linearly withdrawn in the direction of arrow B with respect to its mated position with the second connector 112. It is clear that in the case illustrated in FIG. 9*a*, the operation of the passive latch 150 also increases the unmating force of the first connector 110 with blade-like terminals with respect to the second connector 112 with cantilever beam terminals 130 which increases resistance to accidental unmating. However, the force required to unmate the connectors 110 and 112 in the manner illustrated in FIG. 8*a* is much more than the force required to unmate the-connectors 110 and 112 in the manner illustrated in FIG. 9*a*.

Figure 9B:
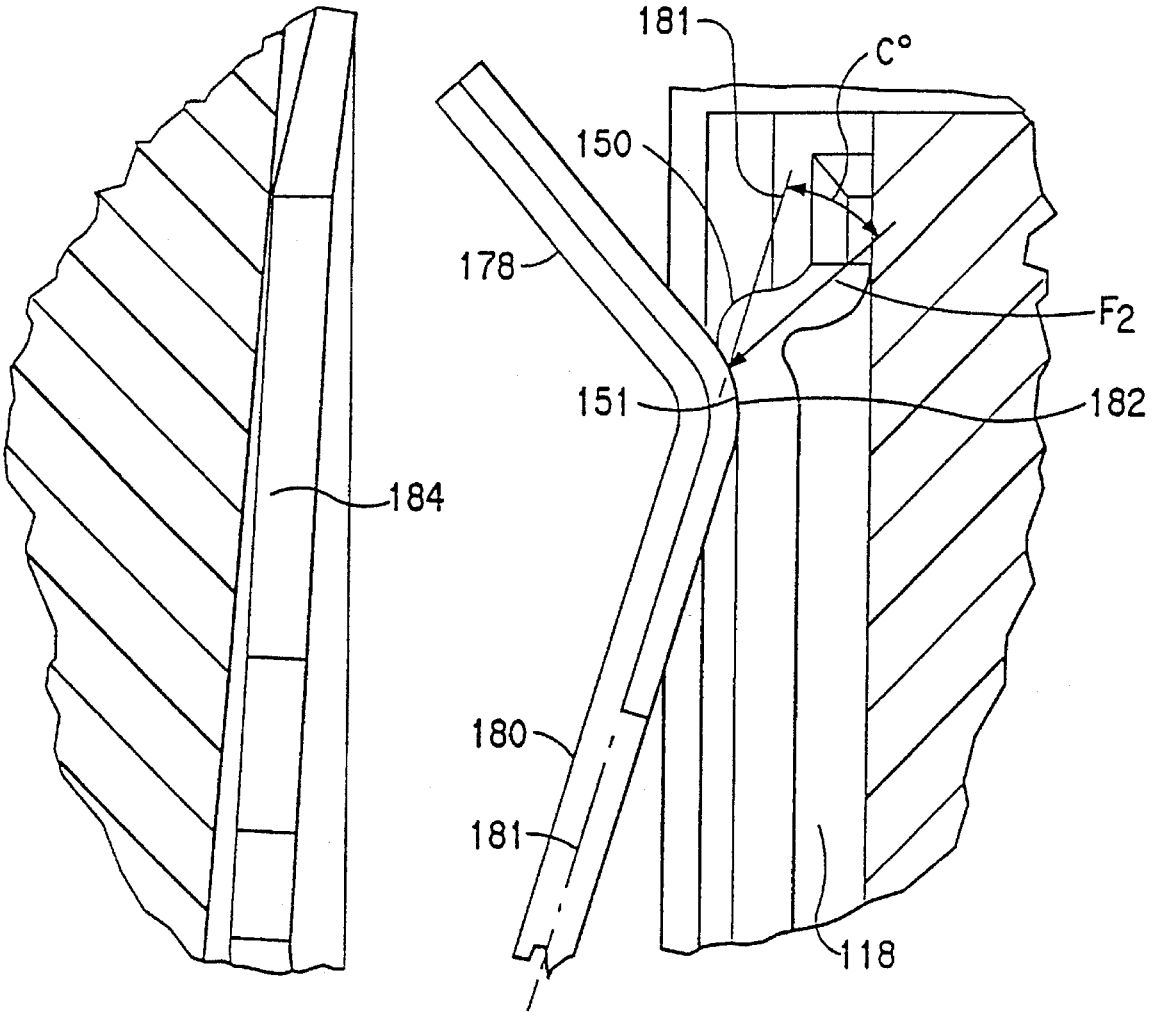
FIG. 9*b* is an enlarged view of part of FIG. 9*a*.

FIG. 9*b* is an enlarged view of part of FIG. 9*a* showing the bent portion 182 in contact with the curved surface 151. As in FIG. 8*b*, the curved surface 151 conforms to the shape of the bent portion 182 contacting the curved surface 151. Arrow $F_2$ represents the effective force applied by the blade-like terminal 118 or, more specifically, the first transistion portion 149 on the bent contact portion 182 of the terminal 130 in FIG. 9*b*. As before, the effective force, F, is defined as the sum of all the forces applied by the first transistion portion 149 on the bent contact portion 182 of the terminal 130. With the first connector 110 linearly withdrawn with respect to the other connector 112 as illustrated in FIG. 9*b*, the effective force $F_1$ is directed at an acute angle C (i.e., an angle of less than 90 degrees) with respect to the longitudinal axis 181 of the second substantially straight portion 180 of the terminal 130. Thus, the first beam 176 including the second substantially straight portion 180 continues to function as a cantilever beam, rather than a column being compressed substantially along its longitudinal axis 181. Further, $F_1$ is greater than $F_2$.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector assembly, comprising:

a first connector for mechanical and electrical connection to a first circuit assembly;

a second connector for mating with the first connector and for mechanical and electrical connection to a second circuit assembly, the second connector comprising:

an insulative female connector housing;

a plurality of cantilever beam terminals disposed in said female connector housing, each one of the cantilever beam terminals comprising:

a first beam having a first substantially straight portion and a second substantially straight portion, the first substantially straight portion joined to the second substantially straight portion by a bent first contact portion;

a second beam;

a bent transition portion joining the second substantially straight portion of the first beam with the second beam such that the first contact portion points away from the second beam; and a solderable tail portion connected to the second beam, the solderable tail portion for mechanical and electrical connection to the second circuit assembly;

the first connector comprising:

an insulative male connector housing;

a plurality of blade terminals disposed in said male connector housing, each one of the blade terminals comprising:

a strip-like contact portion having a substantially flat surface for wiping and contacting one of the first contact portions of one of the cantilever beam terminals of the second connector;

a first transition portion connected to the strip-like contact portion, the first transition portion comprising a retentive bump and a curved surface disposed between the retentive bump and the strip-like contact portion;

a solderable tail portion for mechanical and electrical connection to the circuit assembly; and a second transition portion connecting the strip-like contact portion and the solderable tail portion.

2. The electrical connector assembly of claim 1, wherein the retentive bump is displaced from and does not contact the first contact portion when said first and second connectors are fully mated.

3. The electrical connector assembly of claim 1, wherein the curved surface conforms to the shape of the first contact portion.

4. The electrical connector assembly of claim 3, wherein the first contact portion contacts the curved surface during unmating of the first and second connectors.

5. The electrical connector assembly of claim 3, the second substantially straight portion having a longitudinal axis, wherein the first contact portion contacts the curved surface such that an effective force applied by the first transition portion on the first contact portion is directed substantially toward the second substantially straight portion and substantially parallel to the longitudinal axis during unmating of the first and second connectors.

6. An electrical connector assembly, comprising:

a first connector;

a second connector for mating with the first connector, the second connector comprising:

an insulative female connector housing;

a plurality of cantilever beam terminals disposed in said female connector housing, at least one of the cantilever beam terminals comprising:

a beam having a first portion and a curved contact portion joined to the first portion;

the first connector comprising:

an insulative male connector housing;

a plurality of blade terminals disposed on said male connector housing, at least one of the blade terminals comprising:

an insertion end portion;

a strip-like contact portion having a substantially flat surface for wiping and contacting the contact portion of the at least one cantilever beam terminal of the second connector; and a first transition portion connecting the insertion end portion and the strip-like contact portion, the first transition portion comprising an inclined retentive surface disposed between the insertion end portion and the strip-like contact portion, the retentive surface being spaced from the at least one cantilever beam terminal when the first connector is fully mated to the second connector.

7. The electrical connector assembly of claim 6, wherein a portion of the retentive surface conforms to the shape of the curved contact portion.

8. The electrical connector assembly of claim 6, wherein a portion of the retentive surface contacts the curved contact portion during unmating of the first and second connectors.

9. A blade-like terminal for use in a first multi-contact connector having a plurality of said blade-like terminals and being adapted to mate with a second multi-contact connector having a plurality of deflectable beam members, comprising:

a contact portion having a substantially flat contact surface for electrically contacting one of said beam members of said second connector;

a passive latch integral with said contact portion and having a retentive surface in a non-linear disposition to said contact surface such that the force required to mate said first and second connectors is less than the force required to unMate said first and second connectors; and wherein said blade-like terminal is substantially nondetectable.

10. The terminal of claim 9, wherein at least a portion of said retentive surface forms an incline with respect to said contact surface.

11. The terminal of claim 9, wherein said passive latch comprises a retentive bump.

12. The terminal of claim 9, wherein said first and second connectors are capable of being electrically and mechanically mated together and said passive latch operates to prevent accidental electrical and mechanical unmating of said first and second connectors.

13. A blade-like terminal for use in a first multi-contact connector, comprising:

a contact portion having a substantially flat contact surface for electrically contacting a terminal of a second multi-contact connector;

a passive latch integral with said contact portion and having a retentive surface in a non-linear disposition to said contact surface such that the force required to mate said first and second connectors is less than the force required to unmate said first and second connectors; and wherein the retentive surface and the terminal of the second connector are physically spaced apart from one another when the first and second connectors are fully mated together.

14. The terminal of claim 13, wherein at least a portion of said retentive surface forms an incline with respect to said contact surface.

15. The terminal of claim 13, wherein said passive latch comprises a retentive bump.

16. The terminal of claim 13, wherein said first and second connectors are capable of being electrically and mechanically mated together and said passive latch operates to prevent accidental electrical and mechanical unmating of said first and second connectors.

17. A blade-like terminal for use in a first multi-contact connector having a plurality of said blade-like terminals and being adapted to mate with a second multi-contact connector having a plurality of deflectable beam members, comprising:

a contact portion having a substantially flat contact surface for electrically contacting one of said beam members of said second connector;

a passive latch integral with said contact portion and having a retentive surface in a non-linear disposition to said contact surface such that the force required to mate said first and second connectors is less than the force required to unmate said first and second connectors; and said first and second connectors are capable of being electrically and mechanically mated together so that the passive latch operates to prevent accidental electrical and mechanical unmating of said first and second connectors without a separate means to lock the contact portion of the first connector and said beam member of the second connector in electrical and mechanical engagement.

18. The terminal of claim 17, wherein at least a portion of said retentive surface forms an incline with respect to said contact surface.

19. The terminal of claim 17, wherein said passive latch comprises a retentive bump.

* * * * *

UNITED STATES PATENT AND TRADEMARK OFFICE

CERTIFICATE OF CORRECTION

PATENT NO. : 5,599,192

DATED : February 4, 1997

INVENTOR(S) : Stanley W. Olson

It is certified that error appears in the above-indentified patent and that said Letters Patent is hereby corrected as shown below:

On the title page, item [56]: under References Cited, the following patents should appear:

References Cited
U.S. PATENT DOCUMENTS

| | | | |
|---|---|---|---|
| 3,422,395 | 1/69 | Fisher | 339/258 |
| 3,601,775 | 8/71 | Longenecker et al. | 339/176 |
| 4,025,147 | 5/77 | Van Arsdale et al. | 339/176MP |
| 4,037,914 | 7/77 | Fetzer | 339/253R |
| 4,083,617 | 4/78 | Wyatt | 339/47R |
| 4,715,020 | 12/87 | Andrews, Jr. et al. | 439/59 |
| 4,734,060 | 3/88 | Kawawada et al. | 439/660 |
| 4,954,096 | 9/90 | Frank | 439/346 |
| 4,955,820 | 9/90 | Yamada et al. | 439/83 |
| 4,971,565 | 11/90 | Fox, Jr. | 439/74 |
| 5,022,872 | 6/91 | Schicida | 439/668 |
| 5,181,855 | 1/93 | Mosquera et al. | 439/74 |

Signed and Sealed this

Twenty-ninth Day of April, 1997

*Attest:*

Bruce Lehman

BRUCE LEHMAN

*Attesting Officer*

*Commissioner of Patents and Trademarks*